United States Patent [19]

Turner

[11] Patent Number: 4,792,250

[45] **Date of Patent: * Dec. 20, 1988**

[54] SHAMPOOING APPARATUS

[75] Inventor: Robert B. Turner, Brockton, Mass.

[73] Assignee: Bobbie's Automatic Hair Shampooer, Inc., North Quincy, Mass.

[ * ] Notice: The portion of the term of this patent subsequent to Jun. 23, 2004 has been disclaimed.

[21] Appl. No.: 937,547

[22] Filed: Dec. 3, 1986

Related U.S. Application Data

[63] Continuation of Ser. No. 660,307, Oct. 12, 1984, Pat. No. 4,674,902.

[51] Int. Cl.[4] ..... A46B 11/02

[52] U.S. Cl. ..... 401/43; 401/289; 132/112

[58] Field of Search ..... 401/40, 41, 42, 43, 401/289; 132/112; 4/516

[56] References Cited

U.S. PATENT DOCUMENTS

| | | | |
|---|---|---|---|
| 2,603,223 | 7/1952 | Jefferson | 132/112 X |
| 3,869,216 | 3/1975 | Cseke | 401/43 |
| 3,910,265 | 10/1975 | Coleman | 401/43 X |
| 4,171,169 | 10/1979 | Williams | 401/43 X |
| 4,417,826 | 11/1983 | Floros | 401/43 X |
| 4,629,347 | 12/1986 | Poppitz | 401/43 X |

FOREIGN PATENT DOCUMENTS

| | | | |
|---|---|---|---|
| 2735533 | 1/1979 | Fed. Rep. of Germany | 4/518 |

*Primary Examiner*—Robert P. Swiatek

*Attorney, Agent, or Firm*—Wolf, Greenfield & Sacks

[57] ABSTRACT

A shampooing apparatus or device that is a portable, lightweight, and easily operated for providing automatic shampooing and/or conditioning. The apparatus comprises a body having a dispensing head and adapted to contain at least one but preferably two capsules one of which may contain a shampoo concentrate and the other a conditioner. The body receives these capsules and also receives liquid under pressure from a source of the liquid. In the two capsule version there are separate output ports that couple to a common entry port into a cylindrical cavity of the dispensing head. The dispensing head is of pulsating type including a rotor. In an alternate embodiment in place of the capsules are provided externally disposed containers for the conditioner and shampoo.

23 Claims, 4 Drawing Sheets

5
12
32
30
18
10
14
54
15
46
45
44
46
5
16
22

32
38
38
36
42
42
35
35
34
71
37
41
39
48
35
38
38
36
3
59
4
52
50
54
53
10
72
40
30
80
54
84
53
82
83
4
3

57
66
70
76
32
12
35
72
78
40
34
35
57
30
45
44
42

63
60
57
57
18
20
53
61
62
90
53
53
84
10
57
57
86
88
59
16

SHAMPOOING APPARATUS

This application is a continuation of application Ser. No. 660,307, filed Oct. 12, 1984, now U.S. Pat. No. 4,674,902.

BACKGROUND OF THE INVENTION

The present invention relates in general to a shampooing apparatus and pertains more particularly, to a portable, lightweight, hand-held shampooing device. The device of this invention provides for automatic shampooing, automatic rinsing and automatic conditioning.

It is an object of the present invention to provide, a portable, lightweight, hand-held, shampooing apparatus operated by a user to provide for substantially automatic shampooing.

Another object of the present invention is to provide an improved shampooing device that provides for a pulsating stream of liquid in combination with the injection of a shampoo, conditioner, or other soluble material into the stream of liquid.

A further object of the present invention is to provide an improved shampooing apparatus in which the shampoo, conditioner or the like, is injected into the water or other liquid stream just before the pulsator so as to provide a mixing action.

Still another object of the present invention is to provide an improved shampooing apparatus which is adapted to receive capsules of shampoo, conditioner or the like and which is operated from a conventional inlet water line. The inlet water force provides the dual function of injection of the shampoo, conditioner or the like, and also provides the pulsating action as to be described in more detail hereinafter.

Still a further object of the present invention is to provide an improved shampooing apparatus that is extremely easy to operate, requires substantially no maintenance, can be constructed relatively inexpensively, and which can be operated by persons of virtually any age.

SUMMARY OF THE INVENTION

To accomplish the foregoing and other objects of this invention there is provided a shampooing apparatus that comprises a body, a dispensing head, means for supporting a dispensing head from the body and at least one capsule contained in the apparatus. This capsule is preferably sealed at both ends, is of substantially cylindrical shape and contains a chemical such as a shampoo concentrate or conditioner. The body has means for receiving the capsule and in a preferred embodiment of the invention the apparatus comprises a pair of capsules one containing a shampoo concentrate and the other containing a conditioner. The body also has means for receiving a liquid under pressure which may be a water pressure line. Means are provided for coupling from the capsule under force of the pressurized liquid to the dispensing head. The body preferably has a first passage for direct flow of the pressurized liquid to the dispensing head and there is also preferably provided a second passage leading from the capsule to the dispensing head. In accordance with the invention there is provided a first switch means associated with the body and having one position enabling liquid flow through the first passage and another position blocking liquid flow in the first passage. The first switch means preferably includes a slide member normally biased to a switch closed position blocking liquid flow. There is also preferably provided a second switch means having alternate positions for coupling either one or the other capsules to the dispensing head. The second switch means preferably includes a slide member for mutually exclusively blocking and unblocking second passages from the respective capsules. The switch means that are provided are preferably manually operated switches. Also, the dispensing head has a rotor for providing pulsating action. In order to enable coupling of the shampoo or conditioner out of the associated capsules, each capsule is provided with a piston or the like that is operated under water pressure on a selective basis. This means for piercing includes blade means comprising a blade at each end of each capsule.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 1:
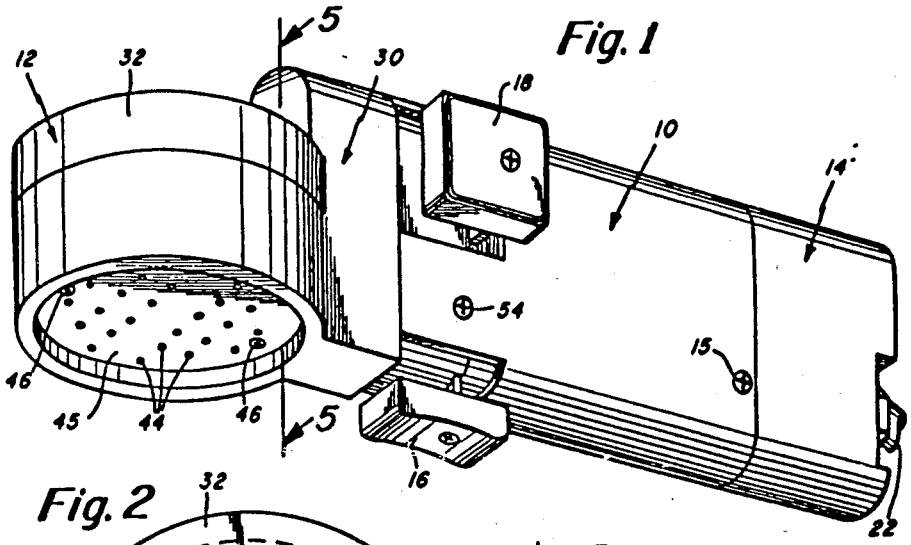
FIG. 1 is a perspective view showing a preferred embodiment of the shampooing apparatus or shampooing device fo this invention.
Figure 8:
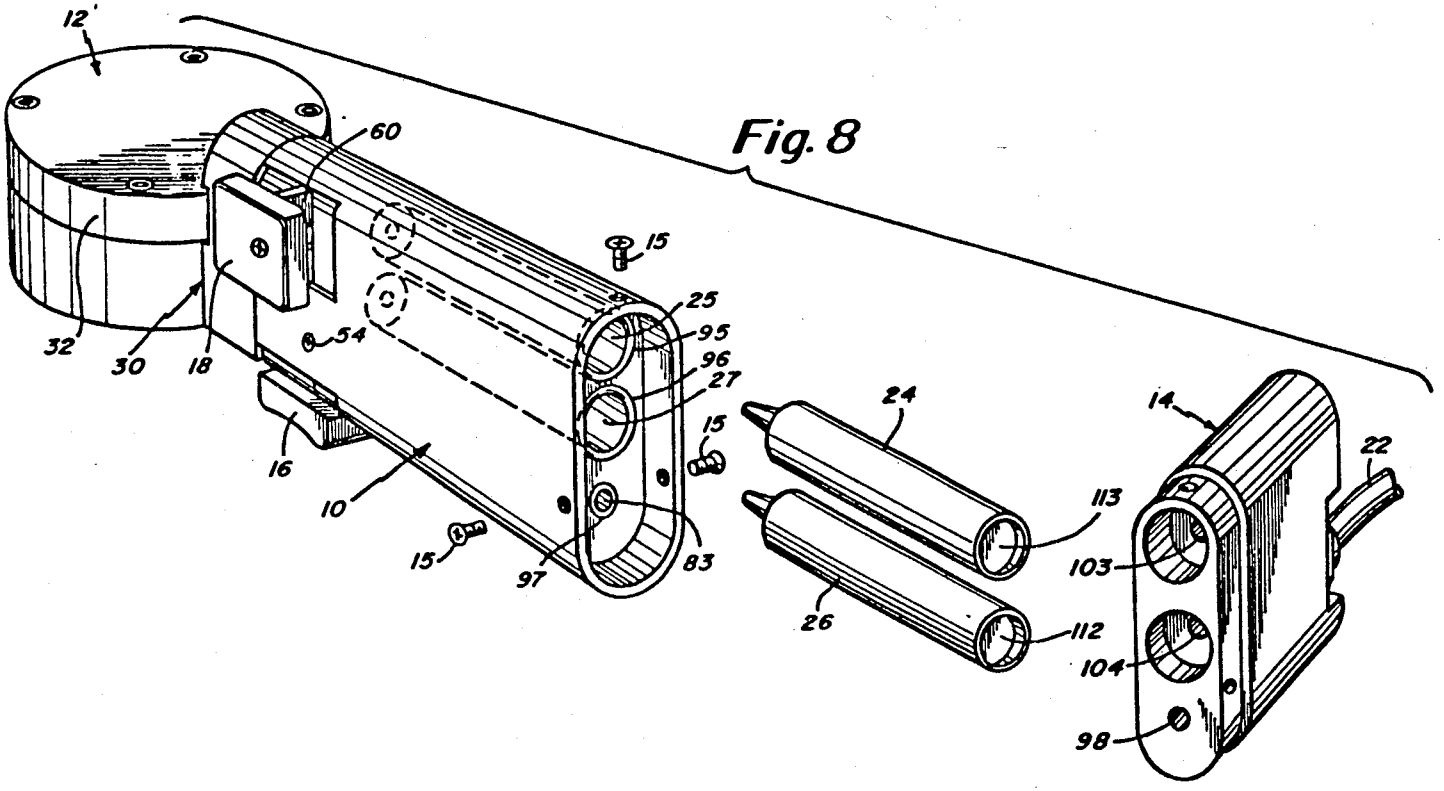
FIG. 8 is a perspective exploded view of the apparatus described in FIGS. 1–7 showing in particular, the apparatus opened with two capsules positioned for insertion into the apparatus.

With reference to the drawing, it is noted that FIGS. 1 and 8 show perspective views of the apparatus in a preferred embodiment. In FIG. 1 the apparatus is shown in its assembled condition. FIG. 8 shows an exploded view with the apparatus having been opened and showing the capsules ready for positioning in the apparatus. FIGS. 2–7 show further specific details of the shampooing apparatus described herein.

As illustrated in FIGS. 1 and 8, the shampooing apparatus broadly comprises a body 10, pulsating dispensing head 12, and removable end member 14. FIGS. 1 and 8 also show the actuating buttons including actuating button 16 and actuating button 18. As noted in FIG. 4 and described in further detail hereinafter, the button 18 has a corresponding and cooperating button 20 disposed on the opposite side of the body 10. The actuating button 16 is for controlling water flow from the inlet line 22 to the pulsating dispensing head 12. The buttons 18 and 20 are cooperatively operated in opposite side directions so as to selectively couple either the shampoo capsule or the conditioner capsule via associated output ports to the head 12.

With reference to FIG. 1, it is noted that the apparatus is shown in its opened position with the end member 14 having been removed from the body 10. In the embodiment that is described, three screws 15 are used to secure the end member 14 to the body 10. In a preferred embodiment, instead of employing securing screws 15, there may be substituted a quick disconnect arrangement. FIG. 8 also shows two capsules comprising a first capsule 24 which may contain a shampoo concentrate and a second capsule 26 which may contain a conditioner. The capsules 24 and 26 are adapted for insertion into corresponding capsule-receiving passages 25 and 27, respectively. Reference will be made hereinafter to the manner in which the capsules 24 and 26 are used and the manner in which the products contained in these capsules are dispensed therefrom and injected to the head 12.

Figure 2:
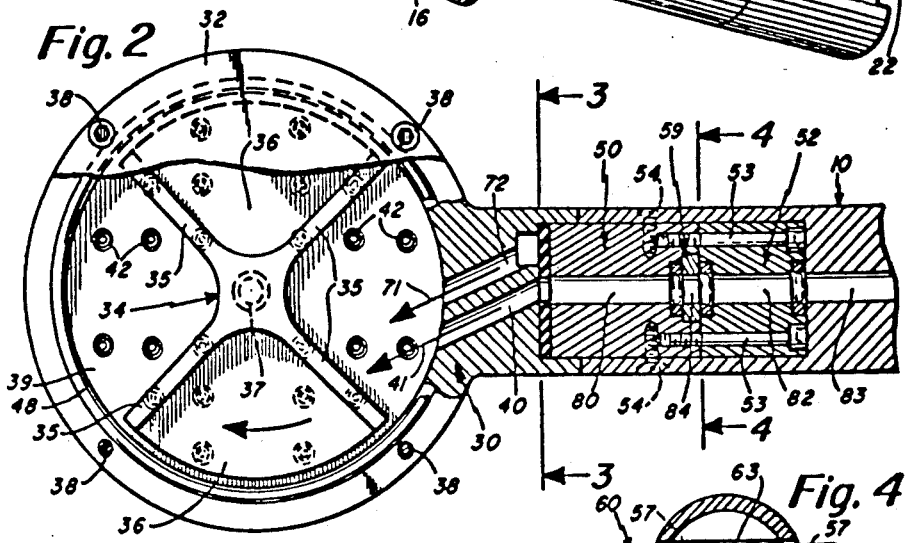
FIG. 2 is a fragmentary cross-sectional plan view of the device illustrated in FIG. 1 showing details of the pulsating head of the apparatus.
Figures 5, 6, 7:
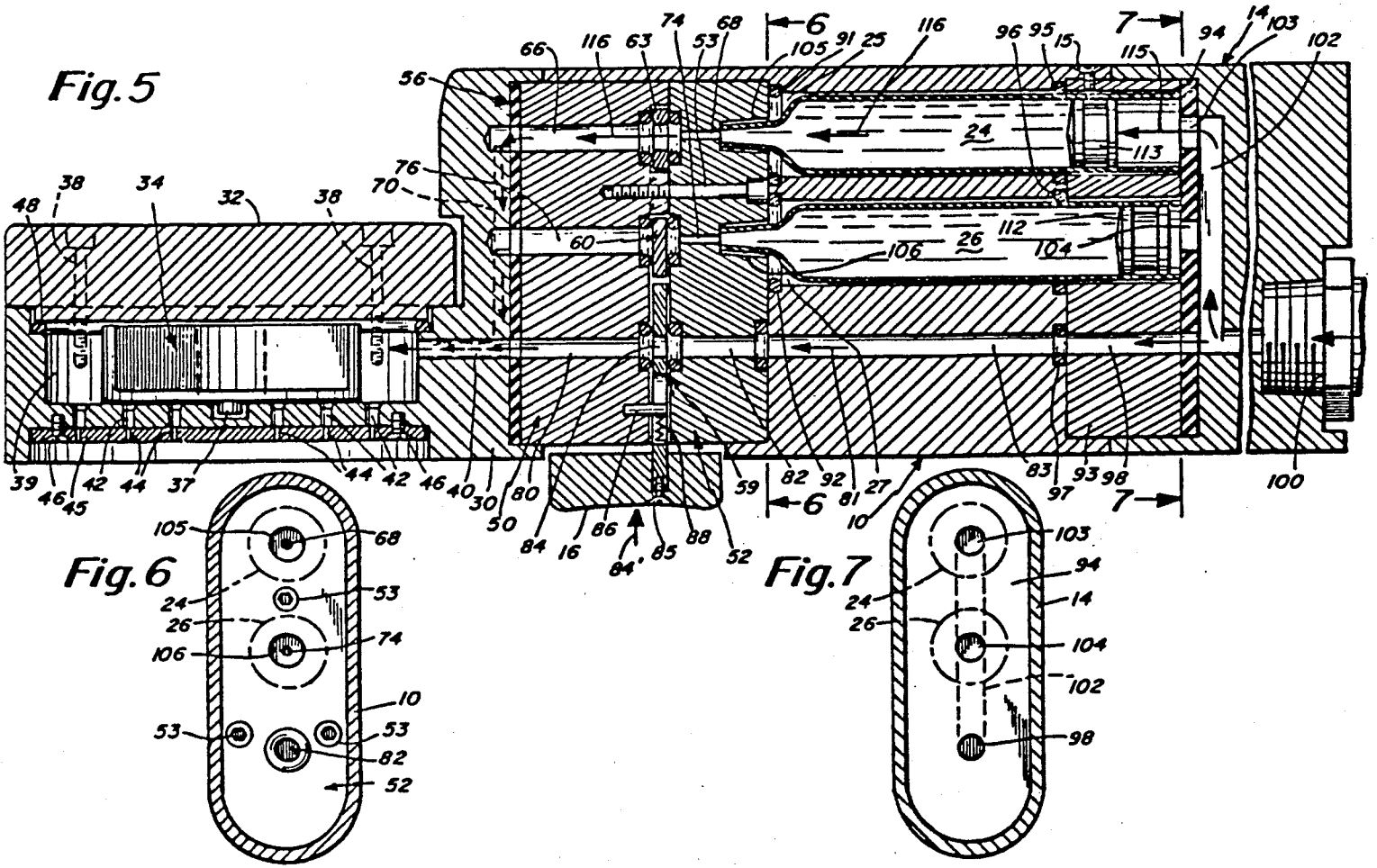
FIG. 5 is a longitudinal cross-sectional view as taken along line 5—5 of FIG. 1 showing further details of the shampooing device with both a shampoo capsule and a conditional capsule in place in the device and with the aforementioned actuating buttons being in a position for selecting the shampoo mode of operation.
FIG. 6 is a cross-sectional view taken along line 6—6 of FIG. 5.
FIG. 7 is a cross-sectional view taken along line 7—7 of FIG. 5.

The pulsating dispensing head 12 comprises a main body 30 shown in detail in FIGS. 2 and 5, top member 32, and rotor 34. FIG. 2 illustrates the configuration of the rotor 34 including four rotor blades 35 and associated interconnecting base webs 36. The rotor 34 also has a bottom supporting post 37 supported in a recess in the main body 30 for properly locating the rotor 34 and enabling rotation thereof.

As indicated in FIGS. 2 and 5, there are provided four securing bolts 38 adapted to secure the top member or cover 32 over the body 30 and rotor 34. The top member 32 and body 30 define a cylindrical cavity 39 in which the rotor 34 is disposed. The rotor 34 provides for a pulsating action and is driven primarily from the main water supply in the passage 40 in the main body 30 of the pulsating dispensing head 12. In this connection, reference is made to FIG. 2 which shows the water line 40 with the water pressure in the direction of the arrow 41 directed toward the rotor 34 causing rotation thereof and corresponding pulsation of the water outputted from the dispensing head 12.

As noted in FIGS. 2 and 5, the main body 30 of the head 12 is provided with a series of apertures 42 disposed below the rotor 34 and leading from the cylindrical cavity 39. These apertures align with corresponding apertures 44 in the aperture plate 45. FIG. 5 shows screws 46 for securing the aperture plate 45 in the proper position relative to the main body 30. The aperture plate 45 is secured in a position wherein the apertures 44 align with the apertures 42 in the main body 30.

FIGS. 2 and 5 also show the use of an O-ring 48 for providing a water tight seal between the main body 30 and the top member or cover 32.

The body 10 of the shampooing apparatus is shown in detail in FIG. 5. Furthermore, cross sections of FIG. 5 are illustrated in FIGS. 6 and 7 with these cross-sectional views being taken at opposite ends of the capsules 24 and 26. Between the body 10 and the pulsating dispenser head 12, there are provided support blocks 50 and 52. These blocks 50 and 52 are secured together by means of three securing bolts 53. One of these bolts is illustrated in the cross-sectional view of FIG. 5 and a cross-section is taken through all of these bolts in the cross-sectional view of FIG. 4. These securing bolts are also illustrated in FIG. 2. FIG. 2 also shows the manner in which the body 10 is secured to the support block 50 by means of the screws 54. Also refer to these securing screws 54 shown in FIGS. 1 and 8.

FIG. 5 also shows an end gasket 56 disposed between the support block 50 and the main body of the head 12. Securing screws are also used, identified in FIG. 4 as screws 57 for securing the support blocks to the main body 30 of the pulsating dispensing head 12. In this connection, also refer to FIG. 3 which shows these securing screws 57 in cross-section.

Figure 3:
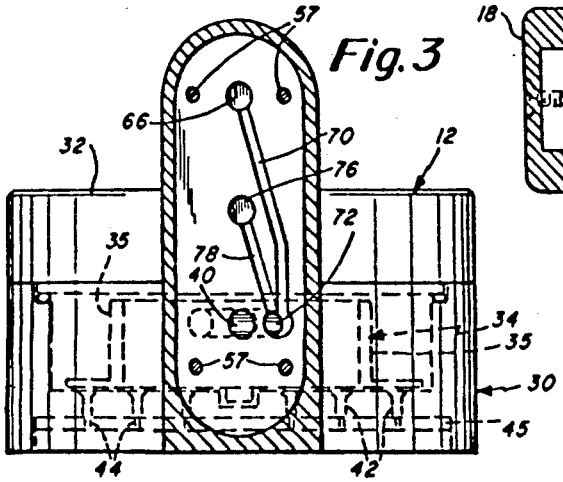
FIG. 3 is a cross-sectional view taken along line 3—3 of FIG. 2 showing in particular, the porting to the shampooing head.
Figure 4:
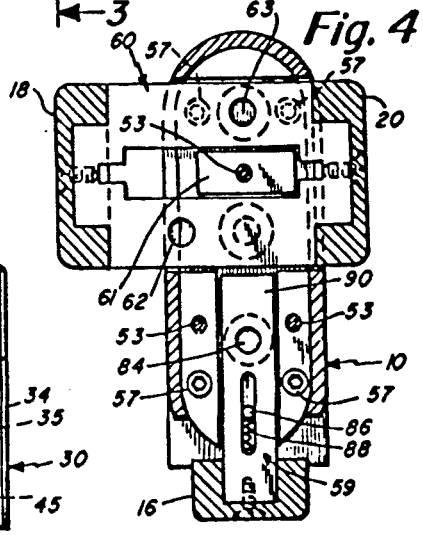
FIG. 4 is a cross-sectional view taken along line 4—4 of FIG. 2 showing in particular the actuating buttons associated with the apparatus.

With reference to FIGS. 3–5, the support blocks 50 and 52 are positioned to support slide members 59 and 60. The aforementioned actuating button 16 is secured to the slide member 59 as shown in FIGS. 4 and 5. The actuating buttons 18 and 20, as depicted in FIG. 4 are secured to opposite ends of the slide member 60. The slide member 60 is guided by means of the platform 61 which is a raised portion of the support block 50. This arrangement provides for limited side-to-side movement of the slide member 60 by pushing on either the actuating button 18 or the actuating button 20 depending upon the direction in which the slide member 60 is to be moved.

As depicted in FIG. 4, the slide member 60 is provided with holes 62 and 63 therethrough. In FIGS. 4 and 5 it is noted that the hole 63 in the slide member 60 is aligned with a passage 66 in the support block 50 and also a passage 68 in the support block 52. In this connection and slide member 60 is in its shampoo mode of operation with there being thus provided a passage from the shampoo capsule 24 by way of passage 68, hole 63 and passage 66 to an output port 70 which in turn coupled to the cylindrical cavity 39 of the pulsating dispensing head 12. In this connection, reference is also made to FIG. 2 which shows the manner in which the port 70 enters the cylindrical cavity 39 at the rotor. The arrow 71 shows the direction of flow of the shampoo concentrate. Moreover, reference may be made to FIG. 3 which shows the manner in which the port 70 extends from the passage 66 to the entry port 72 coupling into the cylindrical cavity 39.

FIG. 5 also shows the conditioner capsule 26 positioned in its accommodating recess 27. Passages are provided in the support blocks 50 and 52 for coupling the conditioner in the capsule to the pulsating dispensing head 12. Thus, there is provided apassage 74 in the support block 52 and a passage 76 in the support block 50. These passages are aligned and upon movement of the slide member 60 to the conditioner position, conditioner can flow between these passages through the hole 62. In the shampoo mode of operation illustrated in FIG. 5, however, the slide member 60 is in the position illustrated and blocks the flow of conditioner from the passage 74 to the passage 76.

In the conditioner mode of operation, the actuating button 18 is moved to the right in FIG. 4 and then the hole 62 aligns with passages 74 and 76 and conditioner can flow to the output port 78. It is noted in FIG. 3 that the port 78 couples from the passage 76 to the entry port 72. There is thus provided a common entry port 72 for both the conditioner and shampoo. This is possible because the device operates on the basis of either the shampoo or conditioner being delivered but not both at the same time. Also, the slide member 60 preferably has an intermediate position which blocks delivery of both the shampoo and conditioner. This position may be used in an initial stage of use of the product when neither conditioner nor shampoo is being dispensed but only water is being dispensed through the device.

FIG. 5 also shows in the support blocks 50 and 52 respective passages 80 and 82. FIG. 5 also shows the slide member 59 in a position in which water flow is coupled by way of passages 80 and 82 to the port 40. In this position of the slide member 59, the hole 84 in the slide member 59 is aligned with the passages 80 and 82. Note in FIG. 5 the arrow 81 which shows water flow through the passage 83 in the body 10 of the shampooing apparatus.

As indicated previously, the actuating button is shown in its depressed position as indicated by the direction of force of arrow 84. The button 16 is secured to the slide member 59 by means of the screw 85. The apparatus also includes a support pin 86 and associated spring 88 for biasing the actuating button and the associated slide member 59 to a restricting position of water flow. In FIGS. 4 and 5, the actuating button 16 has been manually moved upwardly so as to permit water coupling to the pulsating dispensing head 12 so as to provide the pulsating action by virtue of water pressure against the rotor 34. Whe the actuating button 16 is released, the spring bias provided by spring 88 moves the button 16 and the associated slide member 59 downwardly so that the end 90 (see FIG. 4) of the slide member 59 blocks the flow from the passage 82 to the passage 80.

It is also noted that there are a number of O-rings disposed between the support blocks 50 and 52. These provide for a liquid tight seal. The slide members 59 and 60 are adapted to slide relative to these O-rings with an O-ring being associated with each of the passages 66, 76 and 80 on either side of the slide members as clearly illustrated in FIG. 5.

In addition, in FIG. 5 there is shown an O-ring 91 at the left end of recess or cavity 25 and an O-ring 92 at the left end of recess or cavity 27.

FIG. 5 also shows the aforementioned removably end member 14. The member 14 is shown in its removed position in FIG. 8 and is shown secured in place in FIG. 1. When the end member 14 is removed, the capsules 24 and 26 are readily insertable into the body 10. They will extend outwardly from the body a short distance even when seated and once in place, then the removable end member 14 may be secured in the position shown in FIG. 1. The removable end member 14 holds a further support block 93 having on one side thereof a gasket 94.

In connection with the operation of the device of this invention, it is noted that the actuating buttons 16, 18 and 20 may be operated in the following manner. The buttons 18 and 20 may be arranged so that neither shampoo nor condition is dispensed. This means that all of the water pressure is applied directly to the rotor 34, assuming that the button 16 is in a water coupling position as indicated in FIG. 5. This enables direct soaking of the hair with pulsating action. Then, the operator may move the actuating buttons 18, 20 to say the shampoo position. In this position, the majority of the water still goes directly to the rotor to cause the pulsating action but a portion of the water is directed to the shampoo capsule and thus the shampoo concentrate is dispensed into the pulsating action at the dispensing head. The shampooing thus occurs automatically. The same operation also applies to the dispensing of the conditioner into the pulsating water stream.

With regard to the shampoo concentrate and conditioner dispensing, as indicated previously, the capsule 24 contains the shampoo concentrate and the capsule 26 contains the conditioner. The dispensing of these liquids occurs under water pressure and in this connection, reference may be made to FIG. 5 along with FIGS. 7 and 8. As noted in FIG. 5 there is a coupling member 100 to which the water couples. This water passes as indicated previous by way of passages 98 and 83, but also branches by way of passage 102 to a further passage 103 in the gasket 94. The water passes in the direction of arrow 115 as far as passage 103 is concerned. There is also provided a passage 104 in the gasket 94 for applying water pressure to the capsule 26.

With regard to the capsule 24, it is noted that at its front end it is provided with a restricted nozzle that fits within recess 105 in the block 52. Similarly, the capsule 26 also has a nozzle at the front end thereof which fits within the block 52. The nozzle of capsule 24 is in line with passage 68 and the nozzle of capsule 26 is in line with passage 74. Both passages 68 and 74 are in block 52 as noted in FIG. 5.

In order to provide for injection of either the shampoo concentrate or the conditioner to the output passage 70, each of the capsules is provided with a slidable piston which may be a relatively small rubber piston that readily slides within the capsule. FIG. 5 shows the piston 112 within the capsule 26 and the piston 113 within capsule 24. FIG. 5 also illustrates the arrow 115 illustrating the water pressure being applied against piston 113 to cause the shampoo concentrate to be expelled from the capsule 24 in the direction of arrows 116. Similarly, when the conditioner capsule is selected by means of the actuating or selection button, then the water pressure is instead applied to the piston 112 and this causes a centrate within the capsule 26 to be expelled through the passages 74 and 76 eventually to the dispensing head 12.

The capsules when they are initially produced, may be sealed at each of their nozzle ends. They may be punctured in order to open them up or they may have a small cap that is simply removed when the capsules are to be inserted into the shampoo apparatus. Also when the liquid has been dispensed from each of the capsules, they are readily removed and a new capsule is inserted in readiness for use.

The shampooing or conditioner treatment is carried out in accordance with the present invention to provide improved operation. In this connection there is provided for the delivery of a mixture of water and say, shampoo under pulse pressure to the scalp causing a cleaning of the hair through a massaging action. In this connection in FIG. 2, note the passages 40 and 72 which direct the water and shampoo into the pulsating head chamber. The pulsations occur by virtue of rotation of the rotor in combination with output ports. This pulsating action along with the injection of shampoo and water into the pulsating member, causes a cleaning of the hair through such a massaging action.

Figure 9:
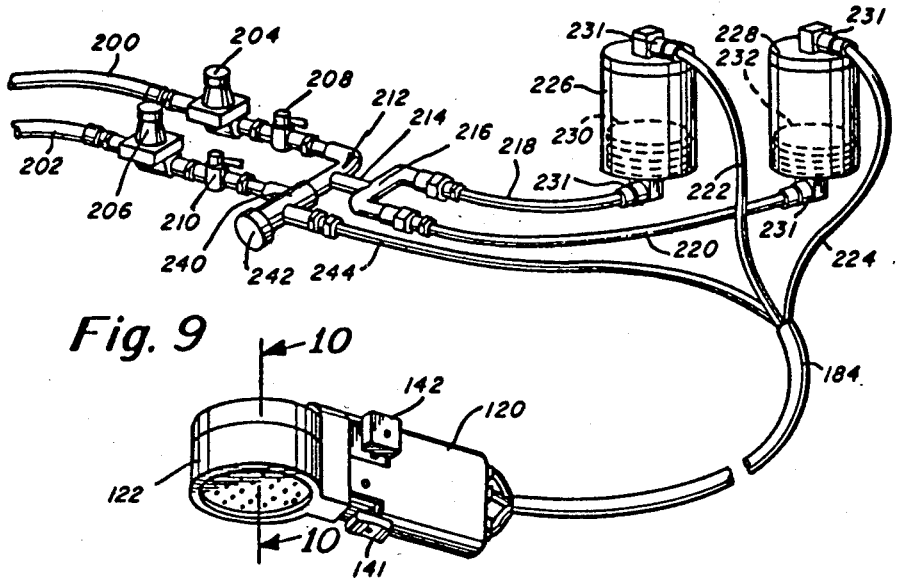
FIG. 9 is a perspective view illustrating an alternate embodiment of the present invention in the form of a shop model employing separate shampoo and conditioner reservoirs.
Figure 10:
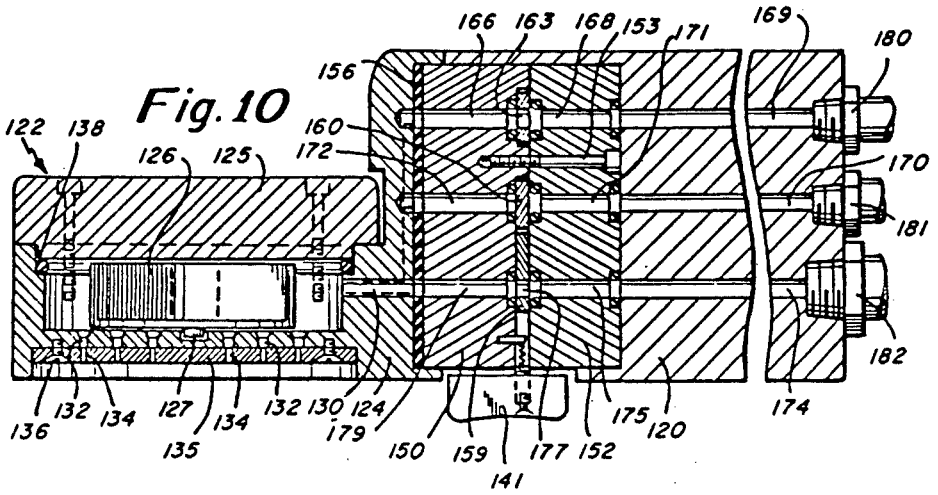
FIG. 10 is a cross-sectional view taken along line 10—10 of FIG. 9 illustrating the internal details of the shampoo head.

Reference is now made to FIGS. 9 and 10 which illustrate an alternate embodiment of the present invention. This embodiment of the invention is adapted primarily for commercial use such as in a beauty shop and is in an embodiment in which the conditioner and shampoo is stored in larger separate containers with these products being fed to the shampoo head.

Thus, in FIG. 9 there is shown a shampoo head which comprises a body 120 and a pulsating dispensing head 122. FIG. 10 is a cross-sectional view taken through the dispensing head along line 10—10 of FIG. 9. As noted in FIG. 10, the construction is substantially the same as the construction previously illustrated in FIG. 5. Thus, the pulsating dispensing head 122 comprises a main body 124, top member 125, and rotor 126. As in the embodiment of FIG. 5, the rotor includes four rotor blades and associated interconnecting base webs. The rotor 126 also has a bottom supporting post 127 supported in a recess in the main body 124 for properly locating the rotor 126 and enabling rotation thereof.

There are provided four securing bolts adapted to secure the top member of cover 125 over the body 124 and rotor 126. The top member 125 and body 124 define a cylindrical cavity in which the rotor 126 is disposed. The rotor 126 provides for a pulsating action and is driven primarily from the main water supply in the passage 130 and the main body of the pulsating dispensing head.

As also noted in FIG. 10, the main body 124 of the head 120 is provided with a series of apertures 132 disposed below the rotor 126 and leading from the cylindrical cavity. These apertures align with corresponding apertures 134 in the aperture plate 135. Screws 136 are used for securing the aperture plate 135 in the proper position relative to the main body. The aperture plate 135 is secured in the position wherein the apertures 134 align with the apertures 132 in the main body 124.

FIG. 10 also illustrates the use of an O-ring 138 for providing a water tight seal between the main body and the top member or cover 125.

The body 120 of the shampooing apparatus is also shown in further detail in FIG. 10. It is noted that the construction of the body is quite similar to the previous arrangement in FIG. 5, but does not make provision for the capsules 24 and 26 because the shampoo and conditioner are coupled to the shampooing head from external containers as illustrated in FIG. 9.

Between the body 120 and the pulsating dispensing head 122, there are provided support blocks 150 and 152. These blocks 150 and 152 are secured together by means of three securing bolts 153. One of these bolts is illustrated in the cross-sectional view of FIG. 10. FIG. 10 also shows an end gasket 156 disposed between the support block 150 and the min body of the head 124. Securing screws are also used for securing the support blocks to the main body of the pulsating dispensing head. The support blocks 150 and 152 are positioned to support slide members 159 and 160. The actuating button 141 is secured to the slide member 159. The actuating button 142 shown in FIG. 9 is secured to the slide member 160. The slide member 160 is guided by means of a platform which is a raised portion of the support block 150. This arrangement provides for limited side-to-side movement of the slide member 160 by pushing on either side of the actuating button 142. This is the same operation as illustrated previously by the actuating buttons 18 and 20 illustrated, for example, in FIG. 4 of the application.

As in the first embodiment, the slide member 60 is provided with holes therethrough. As shown in FIG. 10, the hole 163 in the slide member 160 is lined with a passage 166 and the support block 50 and a passage 168 in the support block 152. In this connection the slide member 160 is in its shampoo mode of operation with there being thus provided a pasage of shampoo from the inlet passage 169 in the body 120 through the passage 168, through the hole 163, and to the passage 166.

FIG. 10 also illustrates the slide member 160 covering and blocking passage of any concentrate in the passage 170. When the slide member 160 is moved to its alternate position, by operation of the actuating button 142, then it is possible for concentrate to pass from the passage 170, through the passage 171, through the hole provided in the slide member 160 and to the passage 172. This is basically the same operation as described in connection with FIG. 5.

There is also illustrated in FIG. 10 a water inlet passage 174 which couples to passage 175 in block 152 through the hole 177 in the slide member 159 and to the passage 179 provided in block 150. This then leads to the outlet passage 130.

As illustrated in FIG. 10, there are also provided three couplings including a coupling 180 associated with passage 169, a coupling 181 associated with passage 170 and a coupling 182 associated with passage 174. Each of these couplings connect to external lines illustrated in FIG. 9. These lines are uncovered by a sheet 184 as illustrated in FIG. 9.

Now, with regard to the system of FIG. 9, there are shown inlet water lines including a cold water line 200 and a hot water line 202. These are the standard hot and cold water lines that are available in any commercial or residential building. These lines may be in the form of flexible hoses and each line connects to a pressure regulator. In FIG. 9 these are illustrated as pressure regulators 204 connecting to line 200 and pressure regulator 206 connecting to hot water line 202. At the output of each of these pressure regulators, there is a connection to a shut-off valve. Accordingly, there is provided a first shut-off valve 208 coupled from the pressure regulator 204 and a second shut-off valve 210 coupled from the pressure regulator 206.

At the output of the shut-off valve 208, there is provided a T-connection 212. At that connection, the cold water temperature may be on the order of say, 50° F. One branch 214 from the T-connection 212 couples to a further T-connection 216 which provides separate branches to lines 218 and 220. This essential split in the cold water line is made so that there can be two separate lines for providing a pressure source to the conditioner land shampoo containers 226 and 228. Also note the quick release members 231 which couple the lines 218 and 220 to the containers 226 and 228, respectively.

It is noted in FIG. 9 that there are also lines 222 and 224. Line 222 couples from the conditioner container 226 while line 224 couples from the shampoo concentrate container 228. Again, there are provided quick release members 231 at the top of each of the containers 226 and 228.

The water pressure at the lines 218 and 220 couple by way of quick release members to the respective bladders 230 and 232. The bladder 230 is contained within the container 226 and the bladder 232 is contained within the container 228. The water pressure causes the respective bladders to expand thus forcing the liquid surrounding the bladders and in each of the containers to be released into the respective lines 222 and 224. There is thus provided an amount of pressure imposed upon the liquids contained in both of these containers to expel the liquid by way of the respective lines 222 and 224 to the output line that couples to the dispensing head. For example, the shampoo line 224 connects to the coupling 180 and from there to the passage 169 in the body and the dispensing head.

Thus, it can be seen that the pressure from each of the bladders essentially pressurizes the containers. These containers may be one quart or larger containers for separate shampoo and conditioner. These lines are then consolidated in one flexible hose as indicated b the reference character 184 and they are then attached to the hand held shampoo head, which as indicated previously, is substantially the same in construction as the apparatus previously described.

With regard to water temperature regulation, it is noted that the output of the shut off valve 210 couples also to a T-connection 240 and from there to a temperature regulator 242. The temperature regulator thus essentially receives the hot water from the shut off valve 210 and the cold water from the shut off valve 208 by way of the T-connection 212. The output from the temperature regulator at line 244 is at a temperature of approximately 103° F. The regulator is adjustable so as to provide a temperature regulation, for example, of over a range of 100°–130°. One temperature regulator that has been used is one manufactured by Watts Regulator Company.

Having described a limited number of embodiments of the present invention, it should now be apparent to those skilled in the art that numerous other embodiments are contemplated as falling within the scope of this invention. For example, there has been described a system in which both conditioner and shampoo is employed. In an alternate embodiment of the invention, one may employ only a single capsule or associated container. This would be the case in the event that one wish to use the product only for, say, shampooing.

What is claimed is:

1. A shampooing apparatus comprising;
a body,
a dispensing head,
means supporting the dispensing head from the body,
at least one capsule container a hair treatment liquid,
said body having means for receiving said at least one capsule,
said capsule having an outlet nozzle at one end and expelling means at the other end,
said body also having means for receiving a liquid under pressure from a source of said liquid,
and means for coupling the hair treatment liquid under force of said pressurized liquid from said outlet nozzle to the dispensing head,
said body having a first passage for direct flow of the pressurized liquid to the dispensing head,
said means for coupling the hair treatment liquid including a second passage leading from the outlet nozzle of said at least one capsule to the dispensing head and a third passage leading from the means for receiving the liquid to the capsule expelling means to provide a force on the capsule expelling means imposed by the pressurized liquid so as to force the hair treatment liquid from the outlet nozzle to thereby couple the hair treatment liquid therefrom to said second passage.

2. A shampooing apparatus as set forth in claim 1 including switch means associated with said body and having one position enabling liquid flow through the first passage and another position blocking liquid flow in the first passage.

3. A shampooing apparatus as set forth in claim 2 wherein said switch means includes a manual switch.

4. A shampooing apparatus as set forth in claim 3 wherein said dispensing head has a rotor for providing pulsating action.

5. A shampooing apparatus as set forth in claim 4 wherein each capsule is opened at one end upon insertion into the body.

6. A shampooing apparatus as set forth in claim 5 wherein each capsule has an open end supporting a piston.

7. A shampooing apparatus as set forth in claim 6 wherein said piston is slidable in said capsule.

8. A shampooing apparatus as set forth in claim 2 including a pair of capsules each containing a different chemical with said body having means for receiving each capsule.

9. A shampooing apparatus as set forth in claim 8 wherein the capsules are arranged in parallel and one has a shampoo concentrate therein while the other contains a conditioner.

10. A shampooing apparatus as set forth in claim 9 including a second switch means having alternate positions for coupling either one or the other of the capsules to the dispensing head.

11. A shampooing apparatus as set forth in claim 10 wherein said first switch means includes a slide member normally biased to a switch closed position blocking liquid flow.

12. A shampooing apparatus as set forth in claim 11 wherein said second switch means includes a slide member for mutually exclusively blocking and unblocking the second passage leading from the respective capsules.

13. A shampooing apparatus as set forth in claim 2 including a pair of capsules and associated pair of second passages leading to a common entry port of the dispensing head.

14. A shampooing apparatus as set forth in claim 13 including a removable end member that is removed to enable insertion of the capsules.

15. A shampooing apparatus comprising:
a body,
a dispensing head,
means supporting the dispensing head from the body,
a source of hair treatment liquid,
said body having means for receiving said hair treatment liquid,
said body also having means for receiving temperature regulated water under pressure,
first switch means for selectively enabling coupling of the water to the dispensing head,
said first switch means including a moveable member having opened and closed positions,
and a second switch means including a moveable member for mutually exclusively blocking and unblocking passages coupling two different hair treatment liquids.

16. A shampooing apparatus as set forth in claim 15 wherein said the source of hair treatment liquid comprises a capsule removably disposed in the apparatus.

17. A shampooing apparatus as set forth in claim 16 including a pair of capsules, one for dispensing conditioner and the other for dispensing shampoo.

18. A shampooing apparatus as set forth in claim 16 wherein said capsule has piston means associated therewith, said piston means being operated from inlet water pressure.

19. A shampooing apparatus as set forth in claim 15 wherein said pulsating head provides for mixing of water and either shampoo or conditioner under pulse pressure delivered to the scalp causing a cleaning of the hair through a massaging action.

20. A shampooing apparatus comprising;

a body, a dispensing head;

means supporting the dispensing head from the body, first and second container each having a different treatment liquid therein, said body having means for receiving water under pressure, said body also having means for receiving treatment liquid, first switch means for selectively enabling coupling of the water to the dispensing head, said first switch means including a moveable member having open and closed positions, second switch means for selecting treatment liquid from one of said first and second containers, said second switch means having alternate positions for coupling one or the other of the containers to the dispensing head.

21. A shampooing apparatus comprising: a body, a dispensing head, means supporting the dispensing head from the body, a capsule containing a hair treatment liquid and including an outlet nozzle and means for expelling the liquid from the outlet nozzle of the capsule under force, said body having means for supporting the capsule, a pressurized water line in the body and coupling to the dispensing head, and means coupling the pressurized water from said line to the capsule expelling means so as to force the hair treatment liquid from the outlet nozzle of the capsule to the dispensing head.

22. A shampooing apparatus as described in claim 21 including a first passage from the water line to the means for expelling, said means for expelling including a piston slideable in the capsule.

23. A shampooing apparatus as described in claim 22 including a second passage from the outlet end of the capsule to the dispensing head.

* * * * *